United States Patent [19]

Vaizey

[11] Patent Number: 4,468,018

[45] Date of Patent: Aug. 28, 1984

BEST AVAILABLE COPY

[54] DEVICE FOR HOLDING LOGS FOR SAWING

[75] Inventor: Geoffrey S. Vaizey, South Chailey, England

[73] Assignee: Glanfield Lawrence (Concessions) Ltd., Brighton, England

[21] Appl. No.: 402,610

[22] Filed: Jul. 28, 1982

[51] Int. Cl.[3] ..... B25B 1/02

[52] U.S. Cl. ..... 269/54.5; 269/53; 269/166; 269/170

[58] Field of Search ..... 269/166, 170, 53–54.3, 269/296, 265, 269, 257; 294/6, 7, 11; 248/538, 520; 81/3, 4

[56] References Cited

U.S. PATENT DOCUMENTS

| | | | |
|---|---|---|---|
| 757,166 | 4/1904 | Wintsch | 269/170 |
| 1,179,980 | 4/1916 | Van Berkel | 269/54 |
| 1,637,654 | 8/1927 | Perez | 269/269 |
| 1,882,297 | 10/1932 | Payne | 269/257 |
| 2,583,896 | 1/1952 | Siebrandt | 269/54 |
| 3,342,478 | 9/1967 | Shaw et al. | 269/54.5 |
| 3,669,390 | 6/1972 | Nielson | 248/538 |
| 4,225,170 | 9/1980 | Flynn | 294/11 |
| 4,258,907 | 3/1981 | Roberts et al. | 269/296 |

FOREIGN PATENT DOCUMENTS

| | | | |
|---|---|---|---|
| 2500022 | 8/1947 | Switzerland | 269/166 |

*Primary Examiner*—Robert C. Watson

[57] ABSTRACT

A device for holding a log for sawing comprises a post having fixed thereto a pair of downwardly pointed spikes carried by a plate. A sleeve is slidable on the post and carries four upwardly pointed spikes on a plate and displaced a greater distance from the post 1 than are the spikes fixed to the post. The log is thus held in cantilevered fashion and the weight of the log causes the sleeve to jam in position against the post. The sleeve is provided with a spring to stop is sliding down the post when not in use. The post may be held in a sleeve hammered into the ground or it may be provided with a base so the device is free-standing.

15 Claims, 3 Drawing Figures

DEVICE FOR HOLDING LOGS FOR SAWING

This invention relates to a device for holding logs for sawing.

When logs are to be used for firewood, they must be cut into suitable short lengths, e.g. of the order of 300 mm. In the past, logs have been placed on a saw horse for sawing. Such a saw horse consists of an open wooden framework, having two end frames, which viewed from one end appears as an 'X' and in use a log simply lies on the saw horse supported by the upper 'V' of the 'X'. This supporting device has two major disadvantages: firstly the saw horse cannot support a log which is shorter than the length of the saw horse between its two end frames and thus the last two cut logs produced will be at least half the length of the saw horse which is too long for many uses. Secondly, the saw horse has no positive means for preventing the logs from rotating during sawing which makes sawing difficult, especially when a motor-driven chain saw is used.

According to the invention there is provided a device for holding a log for sawing comprising a square- or rectangular-section post and having fixed thereto at least two downwardly pointed spikes for engaging a log, and a sleeve closely fitting around and slidably mounted on the post below the fixed spikes and carrying at least two upwardly pointed spikes for engaging the logs at a greater distance from the post than said fixed spikes. In use the sleeve is positioned such that the spikes it carries are spaced below the fixed spikes by a distance approximately equal to the thickness of the log and the log is positioned to engage the spikes. The log is thus held in a cantilevered fashion from the post and the weight of the log causes the sleeve to jam in position on the post.

The spikes carried by the sleeve may be about 200 mm from the post thus enabling the last cut log to be sufficiently short.

The use of at least two fixed spikes and at least two spikes carried by the sleeve provides means for preventing the rotation of the logs in either direction. The spacing of the spikes in at least one of these pairs is preferably from 50–70 mm, more preferably substantially 60 mm.

The sleeve preferably carries the spikes via an arm fixed to the sleeve and projecting outwardly from the post in a direction substantially perpendicular thereto. The spikes are preferably mounted on a plate fixed transversely to the end of the arm. The fixed spikes may be mounted on a plate fixed to the top of the post. The post, sleeve, and arm are preferably square-section steel tubes, and all permanent connections between parts are preferably accomplished by welding.

The sleeve may carry further spikes for providing additional support for a log and in the preferred form four spikes are carried on the plate welded to the end of the arm.

When the device is hot in use, the sleeve remains in position because the weight of the arm, plate and spikes it carries causes the sleeve to turn against the post. To avoid the danger of the sleeve sliding down the post if the arm is accidently knocked upwardly, a spring, such as a leaf spring, may be provided within the sleeve to urge it lightly into a jamming position. The pressure of the spring may be easily overcome by raising the arm when it is desired to move the sleeve to a new position.

The post may be held by means of a sleeve hammered into the ground and arranged to receive the lower end of the post or it may be provided with a base to that the device is free standing.

In order to prevent the spikes from engaging a log too firmly, the spikes are preferably flat or rounded at their points and more preferably are provided with a flat land of substantially 2 mm diameter at their ends.

An embodiment of the invention will now be described by way of example and with reference to the accompanying drawings, in which.

Figure 1:
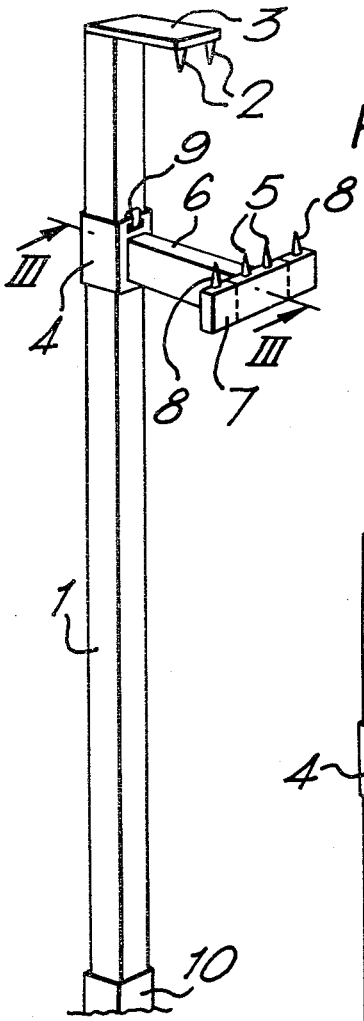
FIG. 1 is a perspective view of a device for holding a log according to the invention.

Referring to the drawings, a device for holding a log for sawing comprises a post 1 having fixed thereto a pair of downwardly pointed spikes 2. The post is made of square-section mild steel tube of 50 mm outside dimension and 4 mm wall thickness. The spikes 2 are welded to a plate 3 which, in turn, is fixed to the top of the post 1 by means of welding. A plate of 70×115 mm and 10 mm thickness has been found to give adequate strength.

Slidably mounted on the post 1 below the fixed spikes 2 is a sleeve 4 of internal dimensions slightly larger than the external dimensions of the post 1. For example, the sleeve may be of 60 mm outside dimension and 4 mm wall thickness giving a clearance space of 1 mm between the sleeve and the post. The sleeve is suitably 75 mm in length. The sleeve 4 carries a pair of upwardly pointed spikes 5 via an arm 6 and a plate 7. Additional spikes 8 also mounted on the plate 7 may provide further support for a log, although these are not essential and may be omitted as indicated by the dotted lines in FIG. 1. The arm 6 is suitably formed of square-section tube of the same dimensions as the post 1 and 205 mm long, and the plate 7 may be 160×50 mm and 10 mm thick. The spikes 5 and 8, the plate 7, the arm 6, and the sleeve 4 are preferably all joined together by welding.

Figure 3:
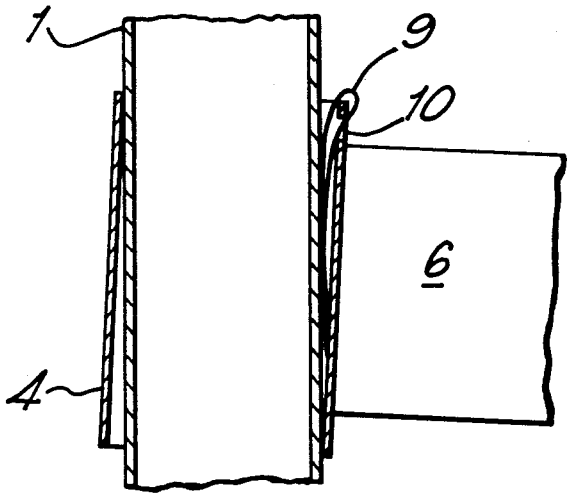
FIG. 3 is a partial cross-section taken along line III—III in FIG. 1.

As best seen in FIG. 3, the sleeve 4 is provided with a leaf spring 9 which passes through a slot 10 in the sleeve. The spring 9 urges the top righthand side (in FIG. 3) of the sleeve 4 away from the post 1 so as to assist the effect of the weight of the arm 6 in jamming the sleeve 4 in position on the post 1.

The spikes 2, 5 and 8 are conveniently formed of 10 mm diameter mild steel rod of 40 mm overall length and provided with a conical taper over a length of 20 mm from the full diameter down to 2 mm diameter so as to provide a flat circular land on the end of 2 mm diameter. This prevents the spikes from digging into the logs too firmly in use which would make the logs difficult to remove from the device. The spacing of the spikes 2 is substantially 60 mm as is the spacings of the spikes 5. It is desirable that at least one of these pairs of spikes should have substanially this spacing as this has been found to give good results in preventing rotation of a log. The use of additional spikes 8 has been found useful in supporting irregularly-shaped logs and a suitable spacing between the spikes 8 is 160 mm.

The post 1 may be held in position by means of a sleeve 10 hammered into the ground. The sleeve 10 may be of square-section mild steel tube of the same dimensions as the sleeve 4 but about 300 mm long. The post 1 is conveniently about 1270 mm long and when inserted in the sleeve 10 provides a holding device at about waist height which is convenient for sawing logs with a chain saw. Alternatively, the post 1 may be made somewhat shorter and provided with a base so that it is free standing.

Figure 2:
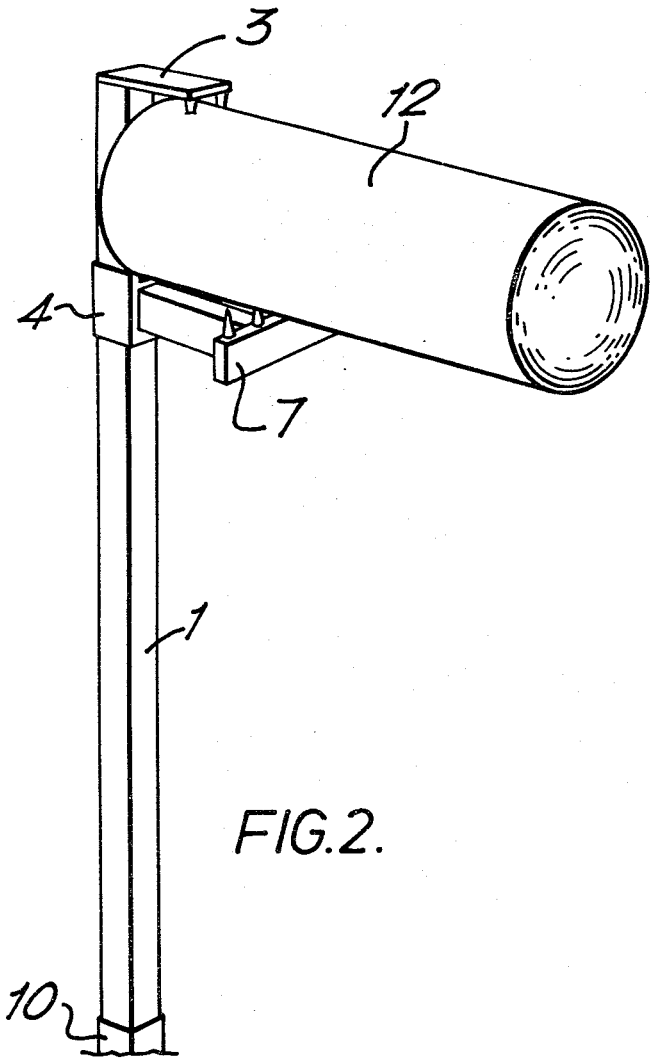
FIG. 2 is a view similar to FIG. 1 showing the device holding a log in use.

In use, the sleeve 4 may be positioned by raising the arm 6 against the pressure of the spring 9 and sliding the sleeve up or down the post 1. On releasing the arm the sleeve remains in position through the action of the spring 9 and the weight of the arm 6 and associated components. A log 12 may then be lifted and placed between the spikes 2 and the spikes 5 and 8 by holding the log with the end near the post 1 lower than the other end. The log may then be lowered to firmly engage the spikes as shown in FIG. 2 whereupon the additional weight of the log on the arm 6 firmly jams the sleeve 4 in position. The log is then held in cantilever fashion and may be sawn e.g. with a chain saw, into the desired lengths. The length of log left after the last cut may be as short as 200 mm. The spikes 2 and 5 are very effective in preventing rotation of the log. For example, if a chain saw tends to rotate the log 12 in a clockwise direction as seen in FIG. 2, the lefthand one of the spikes 2 and the righthand one of the spikes 5 will engage the log more firmly to prevent rotation. Similarly, the other ones of the spikes 2 and 5 will prevent rotation in the opposite direction.

Thus it may be seen that the invention provides a simple and effective device for holding logs for sawing; the device is able to support reliably logs of any diameter from about 60 mm up to the largest log which can be handled by one man.

I claim:

1. A device for holding a log for sawing comprising elongated post means, said post means having an axis, means fixedly supporting at least a first pair of log engaging spikes on said post means, said supporting means spacing said spikes of said first pair from the axis of said post means, and sleeve means closely fitting around and slidably mounted on said post means and carrying at least a second pair of log engaging spikes, the spikes of said second pair being disposed at a greater distance from the axis of said post means than are said spikes of said first pair and extending in a direction which is generally opposite to the direction of extension of the spikes of said first pair, said sleeve means being movable with respect to said supporting means whereby the spacing between the spikes of said first and second pairs may be varied.

2. A device as claimed in claim 1 wherein the spikes of said second pair carried by the sleeve means are displaced substantially 200 mm from said post means.

3. A device as claimed in claim 1 wherein the spacing between the spikes of at least one of said pairs is in the range of 50 mm to 70 mm.

4. A device as claimed in claim 3 wherein said spacing is substantially 60 mm.

5. A device as claimed in claim 1 wherein the sleeve means includes an arm which projects outwardly from said post means in a direction which is generally perpendicular to the axis of said post means, the spikes of said second pair being carried by said arm.

6. A device as claimed in claim 5 wherein said sleeve means further comprises a first plate fixed transversely to the end of said arm, said spikes projecting from said plate.

7. A device as claimed in claim 6 wherein said first plate carries four spikes, said first plate being welded to the end of said arm.

8. A device as claimed in claim 1 wherein said post means includes an elongated post and a plate fixed to the top of said post, said spikes of said first pair being carried by said plate.

9. A device as claimed in claim 1 further comprising a spring positioned between said sleeve means and said post means for urging the sleeve means into a jamming position against said post means.

10. A device as claimed in claim 1 wherein said spikes are flat at their tips.

11. A device as claimed in claim 10 wherein the spikes are provided with a flat land of substantially 2 mm diameter at their tips.

12. A device as claimed in claim 1 wherein said spikes are rounded at their tips.

13. A device as claimed in claim 6 wherein said post means includes an elongated post and a plate fixed to the top of said post, said spikes of said first pair being carried by said second plate.

14. A device as claimed in claim 13 wherein said sleeve means further includes a sleeve which is generally coaxial with said post, said arm being fixed to and movable with said sleeve.

15. A device as claimed in claim 14 further comprising a spring positioned between said sleeve and said post for urging the sleeve into a jamming position against said post.

* * * * *